United States Patent [19]

Horne

[11] 4,075,839

[45] Feb. 28, 1978

[54] DECOMPRESSION OF PRESSURE CHAMBERS, PARTICULARLY THE DECOMPRESSION OF ACTUATING PRESSURE CHAMBERS OF MINE CAGE HOLDING MEANS

[75] Inventor: Peter Nesbitt Horne, Sandton, South Africa

[73] Assignee: Patent Products Hydraulics (Proprietary) Limited, Edenvale, South Africa

[21] Appl. No.: 729,365

[22] Filed: Oct. 4, 1976

[30] Foreign Application Priority Data

Oct. 7, 1975 South Africa ..... 75/6335

[51] Int. Cl.[2] ..... F15B 15/22

[52] U.S. Cl. ..... 60/327; 60/478; 91/442; 251/48; 251/120

[58] Field of Search ..... 60/327, 408, 409, 410, 60/412, 413, 419, 478; 91/4, 5, 442; 137/624.11; 251/12, 48, 54, 55, 120

[56] References Cited

U.S. PATENT DOCUMENTS

| | | | |
|---|---|---|---|
| 2,573,993 | 11/1951 | Sedgwick | 91/4 X |
| 2,938,346 | 5/1960 | Gratzmuller | 60/413 |
| 3,853,300 | 12/1974 | Bryntse et al. | 251/120 |
| 3,991,570 | 11/1976 | Keller | 60/413 |

*Primary Examiner*—Edgar W. Geoghegan
*Attorney, Agent, or Firm*—Young & Thompson

[57] ABSTRACT

Means for controlling the decompression of a pressure chamber, such as an actuating pressure chamber of mine cage holding apparatus, including an outlet passage adapted to communicate with the interior of the pressure chamber; a valve seat associated with the outlet passage; a movable valve member movable into and out of engagement with the seat, the valve member or a part movable therewith being adapted to obstruct the outlet passage during at least part of the travel of the valve member away from the seat with a resistance to the release of pressure from the pressure chamber which decreases with increasing displacement from the seat; a control fluid chamber; a control piston movable in the control chamber and adapted to urge the valve member towards engagement with its seat under the influence of fluid pressure in the control chamber; and a vent from the control chamber through which fluid can escape.

13 Claims, 2 Drawing Figures

DECOMPRESSION OF PRESSURE CHAMBERS, PARTICULARLY THE DECOMPRESSION OF ACTUATING PRESSURE CHAMBERS OF MINE CAGE HOLDING MEANS

This invention relates to the decompression of pressure chambers, particularly the decompression of actuating pressure chambers for mine cage holding means.

It is known to provide fluid operable cage holding means to lock a mine cage in a shaft against movement due to the effects of rope stretch and contraction during loading and unloading. Such cage holding means normally comprises at least one clamping unit mounted on the bridle of the cage, the clamping unit being resiliently biassed towards an open disengaged condition in which the cage is free to operate normally and being adapted to be urged by fluid under pressure against the action of the biassing influence to engage a cage guide in the shaft and lock the cage to the guide. It is also possible for the clamping unit to be mounted at a station in the shaft and arranged to engage a suitable section attached to the cage.

When the cage is required to be unlocked for normal operation, the actuating fluid under pressure is released initially at a predetermined slow rate to permit the cage to move slowly in a controlled manner along the guide to take up any extension of the winding rope of the cage caused by increased weight of the cage during loading, or any contraction of the rope due to decreased weight of the cage during unloading. Once the rope length has adjusted itself to the weight of the cage and the cage is fully suspended from the rope, the actuating fluid pressure is released completely at a rapid rate to permit the resilient biassing means to urge the clamping means to its fully open disengaged condition to permit the cage to operate normally without interference from the clamping means.

It will be appreciated that the release of the actuating fluid pressure requires careful control and it is accordingly an object of the present invention to provide improved decompression control.

According to the invention a method of controlling the decompression of a pressure chamber includes the steps of applying control fluid under pressure to shut off an outlet from the pressure chamber; releasing the control fluid to allow the outlet to open; resisting the release of fluid pressure from the pressure chamber through the outlet; and progressively decreasing the resistance to the release of fluid pressure through the outlet with decreasing pressure in the chamber as control fluid is released, the decrease in the resistance to the release of fluid pressure being controlled by the release of the control fluid.

The control fluid may be released at a predetermined rate to decrease the resistance to the release of fluid pressure through the outlet at a required rate, thereby to release fluid pressure from the compression chamber at a required rate.

The resistance to the release of fluid pressure may initially be decreased at a predetermined low rate until a predetermined pressure is reached, whereafter the resistance to the release of fluid pressure through the outlet may be decreased at a higher rate to increase the rate of pressure release.

The outlet may be obstructed partially during the initial release of pressure until the predetermined pressure is reached, whereafter the obstruction may be removed substantially completely to permit rapid further decompression.

According to a further aspect of the invention decompression control means includes an outlet passage adapted to communicate with the interior of a pressure chamber; a valve seat associated with the outlet passage; a movable valve member movable into and out of engagement with the seat, the valve member or a part movable therewith being adapted to obstruct the outlet passage during at least part of the travel of the valve member away from the seat with a resistance to the release of pressure from the pressure chamber which decreases with increasing displacement from the seat; a control fluid chamber; a control piston movable in the control chamber and adapted to urge the valve member towards engagement with its seat under the influence of fluid pressure in the control chamber; and a vent from the control chamber through which fluid can escape at a predetermined rate.

With the arrangement of the previous paragraph, the outlet passage is shut off by the valve member when the latter engages the valve seat. When the valve member moves away from the seat, fluid pressure is released from the pressure chamber but this release is obstructed during at least part of the travel of the valve member away from the seat, the resistance to the release of pressure decreasing with increasing displacement of the valve member from the seat. As a result, the resistance to pressure release decreases with decreasing pressure in the pressure chamber.

By selecting a suitable rate of escape of fluid from the control chamber, the rate at which the valve member is permitted to be displaced away from its seat and therefore the rate of decrease of the resistance to pressure release from the pressure chamber, may be controlled.

The movable valve member may be resiliently biased towards an open position away from the seat, the piston being adapted to urge the valve member towards engagement with the seat against the influence of the bias.

The outlet passage may be obstructed partially during an initial part of the travel of the valve member away from the seat to restrict the release of pressure to a predetermined low rate, the obstruction being removed substantially completely before the valve member reaches the limit of its travel away from the seat to permit further release of pressure at an increased rate.

The valve member may include a spigot movably locatable in the outlet passage with a predetermined clearance through which fluid pressure may be released when the valve member moves off the seat.

It will be appreciated that while the spigot is located in the outlet passage after the valve member has been displaced from the seat, the spigot acts as an obstruction and fluid pressure is released from the pressure chamber through the clearance at a rate depending on the resistance to fluid flow through the clearance. This resistance to fluid flow depends on the length of spigot located in the outlet passage and as the valve member is displaced away from the seat by the biassing influence as fluid is released from the control chamber, the spigot is progressively withdrawn from the outlet passage, thereby to decrease the resistance to fluid flow with decreasing fluid pressure in the pressure chamber. By suitable selection of the relative configurations and dimensions of the co-operating parts and/or the vent from the control chamber any suitable pressure release pattern may be obtained. Preferably, fluid pressure is released at a substantially constant rate from the pressure chamber while the spigot is located in the outlet passage.

The length of the spigot may be less than the length of the path of travel of the valve member away from the seat. In order to compensate for pressure exerted on the spigot and/or valve member the fluid in the pressure chamber and which tends to urge the valve member away from the seat, a compensating pressure surface may be associated with the valve member, the compensating pressure surface being adapted for fluid pressure in the pressure chamber to act thereon in a direction to urge the valve member towards engagement with the seat.

The vent from the control fluid chamber may comprise an outlet passage; and a spigot which is fast with the control piston and is movably located in the outlet passage with a clearance permitting the escape of fluid from the control chamber at a predetermined rate.

The vent may be open continuously.

With such an arrangement, control fluid may be introduced continuously into the control chamber when the pressure chamber is pressurised, thereby continuously to replace fluid escaping through the vent. By shutting off the supply of control fluid when the pressure chamber is to be decompressed, the pressure in the control chamber may be allowed to decrease by escape of fluid through the vent, thereby to allow the valve member to be displaced away from its seat.

Preferably, the control fluid chamber includes an inlet; and a non-return valve operative to prevent escape of control fluid from the chamber through the inlet.

There may also be provided a fluid-tight reservoir in which the control fluid chamber is located; and an inlet for pressure fluid into the reservoir.

The inlet into and the vent from the control fluid chamber may be locatable below the surface of a supply of control fluid in the form of a liquid in the reservoir, the inlet into the reservoir being adapted to admit pressurised gas into the reservoir to place the control liquid under pressure.

With the arrangement of the previous paragraph, compressed air or other gas places the control liquid under pressure so that it enters the control chamber through the non-return valve and the inlet until the pressures within the control chamber and in the reservoir are equalised. Under such conditions there is no leakage of control liquid from the control chamber through the vent and the valve member is held against its seat. To decompress the pressure chamber, the gas pressure is released to decrease the pressure within the reservoir and on the outside of the control chamber, thereby to allow the escape of fluid from the control chamber through the vent.

The reservoir may be associated with a pump adapted to pump fluid from the reservoir to the pressure chamber to pressurise it. The pump may comprise a compressed air actuated, reciprocatory plunger pump with suction and delivery check valves, the pump being adapted to stall when a predetermined maximum pressure in the pressure chamber is reached and to restart automatically when the pressure drops, thereby to maintain the pressure in the pressure chamber substantially constant.

For a clear understanding of the invention a preferred embodiment will now be described by way of example with reference to the accompanying drawings in which.

Figure 2:
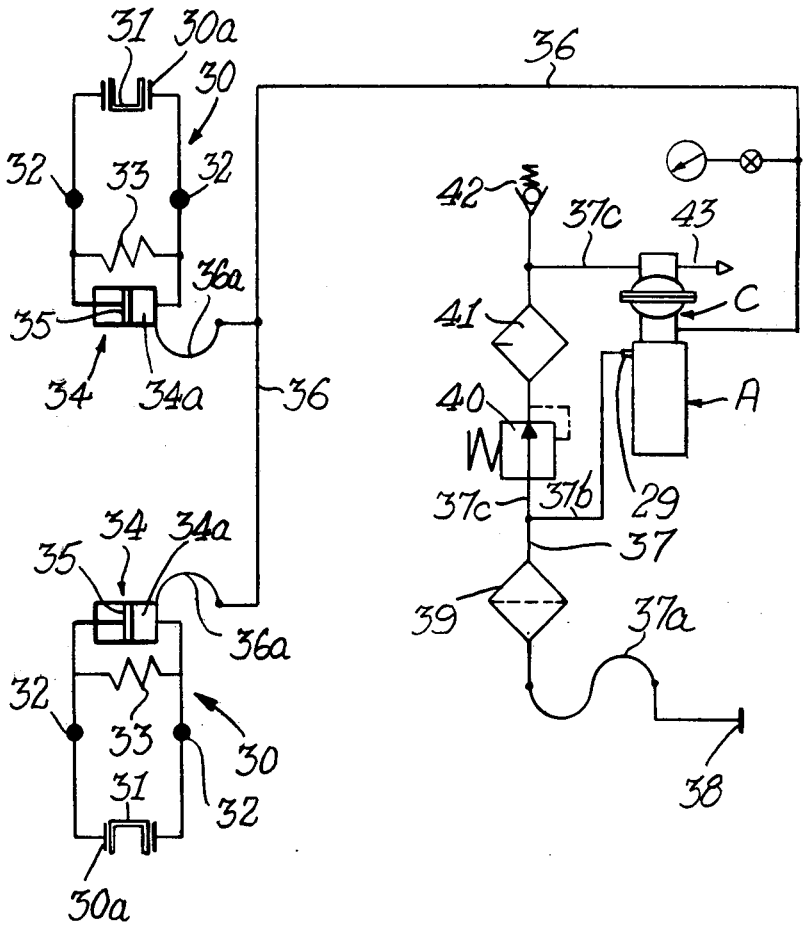
FIG. 2 is a fluid circuit diagram of fluid operable cage holding apparatus incorporating the decompression control means of FIG. 1.

Referring first to FIG. 2, the cage holding apparatus comprises two clamping units 30 mounted on opposite sides of a mine cage (not shown) and adapted to engage stationary guide rails 31 located in a shaft in which the cage is movable. Each clamping unit 30 includes a pair of clamps 30*a* which are pivoted at 32 and are resiliently biassed by springs 33 towards the open positions shown in which clamps 30*a* are disengaged from guide rails 31 and the cage is free to operate normally. Operation of clamps 30*a* is controlled by pressure units 34 comprising pressure chambers 34*a* within which actuating pistons 35 are movable. By introducing fluid under pressure into pressure chambers 34*a* through flexible fluid couplings 36*a*, pistons 35 are displaced to urge clamps 30*a* against the action of biassing springs 33 into engagement with guide rails 31, thereby to lock the cage to guide rails 31. By releasing the fluid pressure in pressure chambers 34*a*, springs 33 are allowed to re-exert themselves and bias clamps 30*a* away from rails 31 to release the cage.

Figure 1:
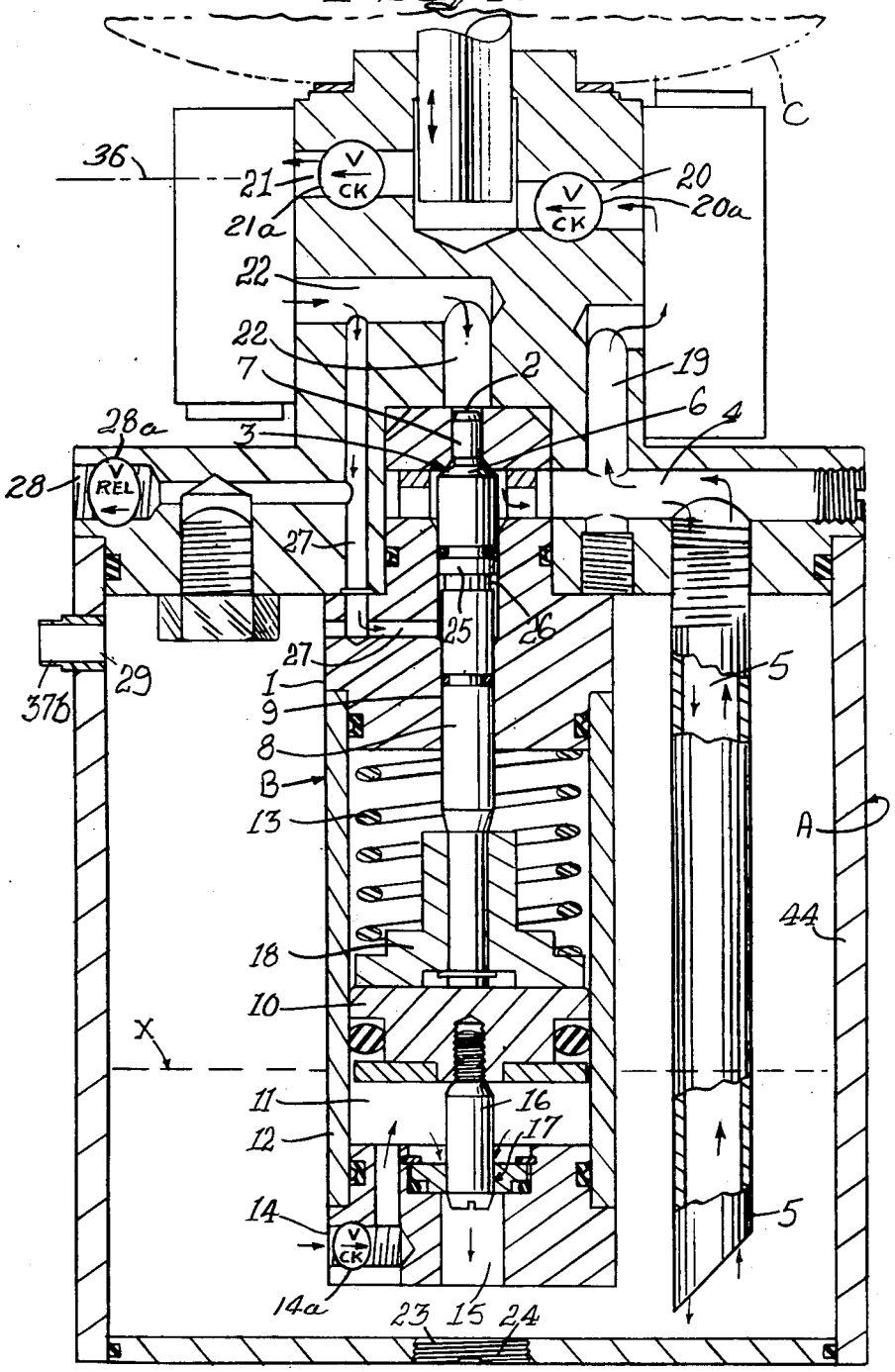
FIG. 1 is a diagrammatic sectional view of decompression control means according to the invention which is suitable for controlling the operation of fluid operable cage holding apparatus.

Fluid couplings 36*a* are connected to the decompression control unit A of FIG. 1 through common fluid line 36. Compressed air for actuating air operable, reciprocatory plunger pump C and for operation of decompression control unit A, is supplied through fluid line 37 which is provided with a coupling 38 adapted for releasable connection to a compressed air supply at a station along the mine shaft at which the clamping units 30 are to be operated. Fluid line 37 includes a flexible portion 37*a* and a filter 39. Fluid line 37 is connected to decompression control unit A through branch line 37*b* and to pump C through branch line 37*c*. Pressure reducing valve 40 and lubricator 41 are connected in branch line 37*c* to pump C. Lubricator 41 introduces a lubricating medium into the compressed air supplied to pump C. A pressure relief valve 42 is connected to branch line 37*c*. Pump C is provided with exhaust outlet 43.

Referring now also to FIG. 1, the decompression control unit A comprises fluid-tight reservoir 44 within which control valve unit B is located. Air operable, reciprocatory plunger pump C of any suitable conventional design, is mounted on the upper end of reservoir 44.

Control valve unit B comprises body 1 defining linear outlet passage 2, the upper end of which is adapted to be connected via passage 22 to the interiors of actuating pressure chambers 34*a* of cage clamping units 30 via fluid line 36. Annular valve seat 3 is located round the mouth of outlet passage 2 at the lower end thereof. The mouth of the outlet passage 2 communicates with the interior of reservoir 44 via passage 4 and conduit 5.

Conical valve member 6 is adapted to engage seat 3 and shut off outlet passage 2 to prevent escape of fluid therethrough from the pressure chambers 34*a*. Spigot 7 which is fast with valve member 6 and projects upwardly therefrom, is movably locatable in outlet passage 2 with a clearance through which fluid can pass when valve member 6 is displaced downwardly away from seat 3. Spigot 7 is adapted to obstruct a flow of fluid through outlet passage 2, thereby to create a resistance to a release of fluid pressure from the pressure chambers 34a. The length of spigot 7 is less than the length of the path of travel of valve member 6 away from seat 3.

Valve member 6 is also fast with depending spindle 8 which is slidably located in bore 9 in body 1 to guide valve member 6 for movement towards and away from seat 3. At its lower end, spindle 8 is fast with formation 18 engageable with control piston 10 which is movable in control fluid chamber 11 defined by tubular housing 12 depending from body 1. Spring 13 is located between the lower end of body 1 and formation 18 and is arranged resiliently to bias valve member 6 downwardly away from seat 3.

Fluid inlet 14 communicating with the interior of reservoir 44 and incorporating a check valve 14a is provided in the bottom of control chamber 11. A fluid outlet 15 in the bottom of control chamber 11 also communicates with the interior of reservoir 44 and a spigot 16 fast with piston 10 is movably located with a clearance in aperture 17 in outlet 15 to provide a vent through which fluid under pressure can escape from control chamber 11 at a predetermined rate.

In use, a supply of oil is introduced into reservoir 44 so that the oil level X is above inlet 14 and outlet 15 of control chamber 11 and also above the lower end of conduit 5. Compressed air is introduced into reservoir 44 through inlet 29 from fluid line 37b and at the same time compressed air is applied through fluid line 37c to pump C to operate the latter. The air pressure in reservoir 44 also forces the oil in the reservoir upwardly through conduit 5 and via passage 19 to the suction inlet 20 of pump C through a check valve 20a. Pump C withdraws oil from reservoir 44 and delivers it through delivery outlet 21 and a check valve 21a to the pressure chambers 34a of cage clamping units 30 via fluid line 36.

The compressed air in reservoir 44 forces oil into control chamber 11 through inlet 14 and its check valve 14a, thereby to displace piston 10 upwardly and urge valve member 6 upwardly against the action of spring 13 until it engages seat 3 to shut off outlet passage 2. The pressures within control chamber 11 and in reservoir 44 at outlet 15 from control chamber 11 are equal and there is no leakage of oil from control chamber 11 through the clearance round spigot 16. Outlet passage 2 is therefore kept shut.

With outlet passage 2 shut off, pump C introduces oil under pressure into the pressure chambers 34a of the cage clamping units 30 until the pressure reaches a value at which pump C stalls. At this pressure the cage clamping units 30 are actuated to lock the cage in the shaft. If there is any drop in pressure, the pump restarts to maintain the pressure.

In order to decompress the pressure chambers 34a and release the cage clamping units 30, the supply of compressed air to pump C and to the interior of reservoir 44 is cut off and reservoir 44 is vented to atmosphere to drop its internal pressure. The oil pressure in control chamber 11 then becomes higher than that in the reservoir 44 and oil is released from chamber 11 past spigot 16 at a predetermined low rate. As the pressure in control chamber 11 decreases, spring 13 re-exerts itself and biasses valve member 6 downwardly so that if it disengages seat 3 and is displaced away therefrom.

As valve member 6 disengages seat 3, fluid under pressure is released from the pressure chambers 34 of the cage clamping units 30 through the clearance between spigot 7 and the wall of outlet passage 2 at a predetermined low rate. When valve member 6 first disengages seat 3, the entire length of spigot 7 is located in outlet passage 2 to define an annular release orifice around spigot 7 having a length corresponding to the length of spigot 7 located in outlet passage 2. As valve member 6 is displaced downwardly, spigot 7 is withdrawn progressively from outlet passage 2 and the length of the release orifice around the spigot decreases with the result that the resistance to discharge of fluid through the discharge orifice decreases as the pressure in the pressure chamber decreases. The pressure can therefore be released at a required rate so that the grip of the cage holding clamps 30a on guide rails 31 is released gradually to permit the cage to move slowly in a controlled manner to take up any change in length of its winding rope caused by a change in its weight due to loading or unloading.

The length of spigot 7 is such that when the pressure in the pressure chamber reaches a predetermined value at which the clamping units 30 have released sufficiently for the cage to have taken up any change in the length of its winding rope due to loading or unloading, the upper end of spigot 7 moves clear of the mouth of outlet aperture 2. The remaining fluid pressure is thus released rapidly over the full cross-section of outlet passage 2, thereby fully to release the cage clamping units 30.

By suitable selection of the rate of escape of oil from control chamber 11 past spigot 16 and also of the rate of escape of oil from the pressure chamber past spigot 7 on valve member 6, any required rate of release of pressure from the pressure chambers may be obtained. The rate of release of pressure from the pressure chambers may be varied by varying the clearance between spigot 16 and aperture 17 in the bottom of control chamber 11. This may be done by replacing spigot 16 which is in screw threaded engagement with piston 10, with another spigot of different diameter through aperture 23 in the bottom of reservoir 44 which is provided with a screw threaded plug 24.

It will be appreciated that many variations in detail are possible without departing from the scope of the accompanying claims. For example, in order to compensate for downward pressure which acts on the upper end of spigot 7 and tends to open valve member 6 when the pressure chambers 34a of the cage clamping units 30 are pressurised, collar 25 is provided on valve spindle 8 in chamber 26 in body 1 in a position below valve member 6. Chamber 26 is in communication with the interior of the pressure chambers 34a via fluid line 36 and passages 22 and 27. Fluid pressure in the pressure chambers is therefore adapted to act upwardly on the lower surface of collar 25 to urge valve member 6 towards seat 3. The upward pressure on collar 25 is slightly less than the downward pressure on the upper end of spigot 7.

A high pressure safety release valve 28a may be provided in the outlet 28 communicating with the interior of the pressure chambers 34a through passages 27 and 22.

I claim:

1. A method of controlling the decompression of a pressure chamber, including the steps of applying control fluid under pressure to shut off an outlet from the pressure chamber; releasing the control fluid to allow the outlet to open; resisting the release of fluid pressure from the pressure chamber through the outlet; and decreasing the resistance to the release of fluid pressure through the outlet with decreasing pressure in the chamber as control fluid is released, the decrease in the resistance to the release of fluid pressure being controlled by the release of the control fluid, wherein the resistance to the release of fluid pressure is initially decreased at a predetermined rate until a predetermined pressure is reached, whereafter the resistance to the release of fluid pressure is decreased at a higher rate to increase the rate of pressure release, and wherein the outlet is obstructed partially during the initial release of pressure until the predetermined pressure is reached, whereafter the obstruction is removed substantially completely.

2. Means for controlling the decompression of a pressure chamber including an outlet passage adapted to communicate with the interior of the pressure chamber; a valve seat associated with the outlet passage; a movable valve member movable into and out of engagement with the seat, the valve member or a part movable therewith being adapted to obstruct the outlet passage during at least part of the travel of the valve member away from the seat with a resistance to the release of pressure from the pressure chamber which decreases with increasing displacement from the seat; a control fluid chamber; a control piston movable in the control chamber and adapted to urge the valve member towards engagement with its seat under the influence of fluid pressure in the control chamber; and a vent from the control chamber through which fluid can escape, wherein the outlet passage is obstructed partially during an initial part of the travel of the valve member away from the seat to restrict the release of pressure to a predetermined rate, the obstruction being removed substantially completely before the valve member reaches the limit of its travel away from the seat to permit further release of pressure at an increased rate.

3. Decompression control means as claimed in claim 2, wherein the movable valve member is resiliently biassed towards an open position away from the seat, the piston being adapted to urge the valve member towards engagement with the seat against the action of the bias.

4. Decompression control means as claimed in claim 2, wherein the valve member includes a spigot movably locatable in the outlet passage with a clearance through which fluid pressure may be released when the valve member moves off the seat.

5. Decompression control means as claimed in claim 4, the length of the spigot being less than the length of the path of travel of the valve member away from the seat.

6. Decompression control means as claimed in claim 2, including a compensating pressure surface associated with the valve member and arranged for fluid pressure in the pressure chamber to act thereon in a direction to urge the valve member towards engagement with the seat.

7. Decompression control means as claimed in claim 2, wherein the vent from the control fluid chamber comprises an outlet passage; and a spigot which is fast with the control piston and is movably located in the outlet passage with a clearance permitting the escape of fluid from the control chamber at a predetermined rate.

8. Decompression control means as claimed in claim 2, wherein the vent is open continuously.

9. Decompression control means as claimed in claim 8, wherein the control fluid chamber includes an inlet; and a non-return valve operative to prevent escape of control fluid from the chamber through the inlet.

10. Decompression control means as claimed in claim 9, including a fluid-tight reservoir in which the control fluid chamber is located; and an inlet for pressure fluid into the reservoir.

11. Decompression control means as claimed in claim 10, wherein the inlet into and the vent from the control fluid chamber are locatable below the surface of a supply of control fluid in the form of a liquid in the reservoir; and the inlet into the reservoir is adapted to admit pressurised gas into the reservoir to place the control liquid under pressure.

12. Decompression control means as claimed in claim 10, including a pump adapted to pump fluid from the reservoir to the pressure chamber to pressurise the latter.

13. Mine cage holding apparatus including decompression control means including an outlet passage in communication with the interior of a pressure chamber of fluid operable cage holding means; a valve seat associated with the outlet passage; a movable valve member movable into and out of engagement with the seat, the valve member or a part movable therewith being adapted to obstruct the outlet passage during at least part of the travel of the valve member away from the seat with a resistance to the release of pressure from the pressure chamber which decreases with increasing displacement from the seat; a control fluid chamber; a control piston movable in the control chamber and adapted to urge the valve member towards engagement with its seat under the influence of fluid pressure in the control chamber; and a vent from the control chamber through which fluid can escape, wherein the outlet passage is obstructed partially during an initial part of the travel of the valve member away from the seat to restrict the release of pressure to a predetermined rate, the obstruction being removed substantially completely before the valve member reaches the limit of its travel away from the seat to permit further release of pressure at an increased rate.

* * * * *